US006092261A

United States Patent [19]

Boomgaarden

[11] Patent Number: 6,092,261

[45] Date of Patent: Jul. 25, 2000

[54] STORAGE SYSTEM FOR VACUUM PICKUP HOSE

[75] Inventor: Steven L. Boomgaarden, Rosemount, Minn.

[73] Assignee: Tennant Company, Minneapolis, Minn.

[21] Appl. No.: 09/098,855

[22] Filed: Jun. 17, 1998

[51] Int. Cl.[7] ..... A47L 9/00

[52] U.S. Cl. ..... 15/323; 15/315; 15/340.1

[58] Field of Search ..... 15/315, 323, 340.1

[56] References Cited

U.S. PATENT DOCUMENTS

| | | | |
|---|---|---|---|
| 2,867,833 | 1/1959 | Duff | 15/323 |
| 3,110,922 | 11/1963 | Senne | 15/315 X |
| 3,261,107 | 7/1966 | Ponczek et al. | 15/315 X |
| 3,739,421 | 6/1973 | Fukuba | 15/315 X |
| 4,050,113 | 9/1977 | Wright et al. | 15/315 |
| 4,366,594 | 1/1983 | Hyams | 15/340.1 X |
| 4,688,292 | 8/1987 | Schmiegel | 15/315 X |
| 5,138,742 | 8/1992 | Charky | 15/340.1 |
| 5,797,162 | 8/1988 | Vystrcil et al. | 15/315 X |

*Primary Examiner*—Chris K. Moore

*Attorney, Agent, or Firm*—McEachran, Jambor, Keating, Bock & Kurtz

[57] ABSTRACT

A vacuum trash collection vehicle includes a vehicle mounted debris container and a hose connected at one end to the debris container. There is a source of vacuum on the vehicle and it is applied to the hose. The hose is open at one end to form a collection nozzle. The hose is boom supported by the vehicle and there are driver accessible controls for moving the hose and nozzle for debris collection. There is a debris collection wand assembly mounted on the vehicle which includes a flexible collapsible hose connected at one end to the debris container and having a source of vacuum applied thereto. There is a valve for controlling the application of vacuum to the collapsible hose. A tubular portable wand is mounted on the vehicle and removable for debris collection. The collapsible hose extends into the tubular wand for connection thereto, with the collapsible hose collapsing into the tubular wand for storage on the vehicle when not in use for debris collection.

8 Claims, 1 Drawing Sheet

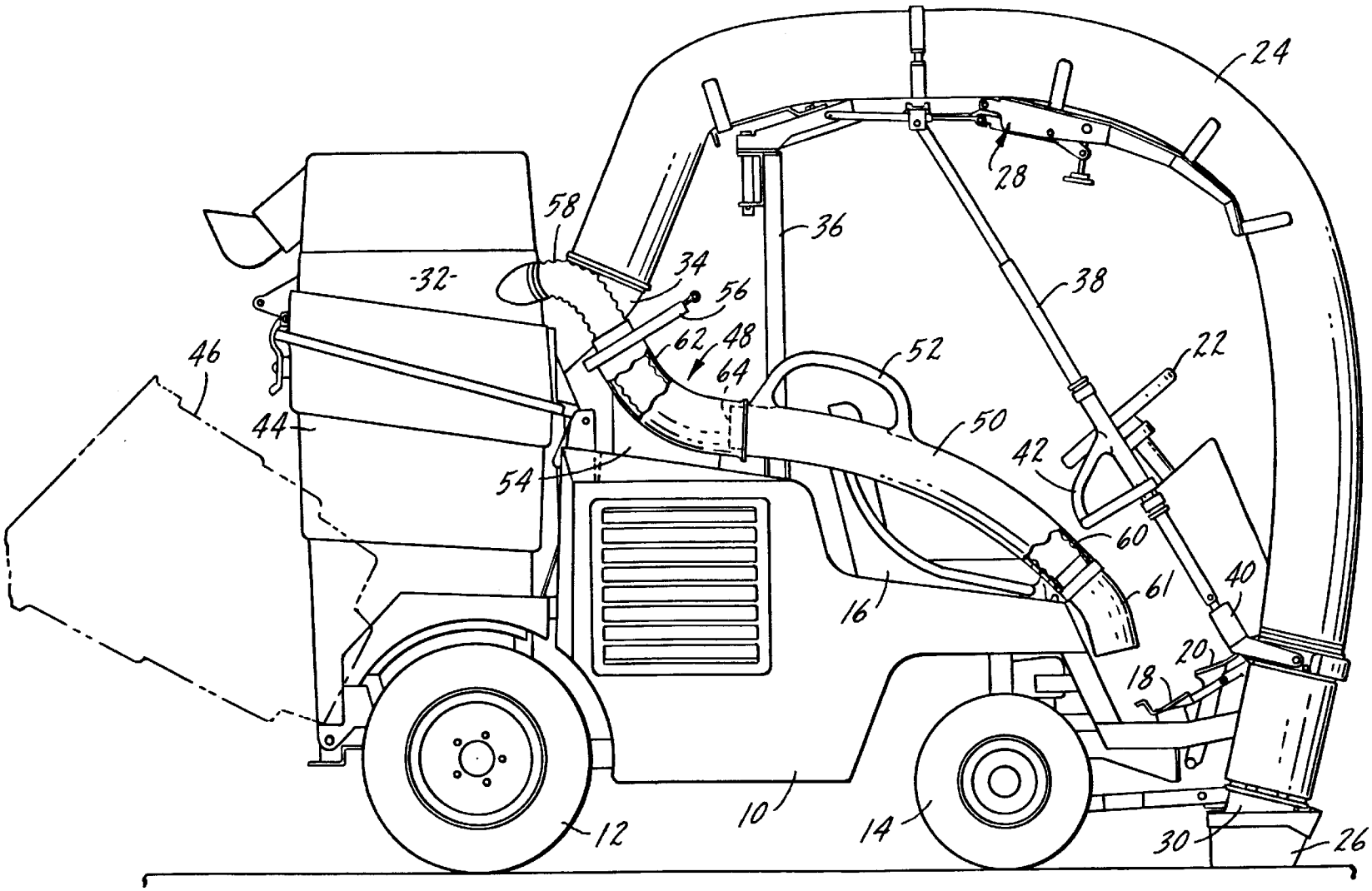
24
26
22
40
20
18
30
38
61
60
42
28
50
52
14
16
36
10
56
48
64
34
62
12
58
54
32
44
46

STORAGE SYSTEM FOR VACUUM PICKUP HOSE

THE FIELD OF THE INVENTION

The present invention relates to debris collection vehicles and particularly to such vehicles which use a large hose, for example 8" in diameter, and directed by the vehicle operator to collect debris. More specifically, the invention is concerned with such a vehicle which further includes a portable removable wand for use by the vehicle operator to collect debris away from the vehicle.

U.S. Pat. Nos. 3,710,412, 5,058,235, 5,138,742 and 5,519,915 all show vacuum trash collection vehicles of the type disclosed herein. Such vehicles have a boom supported hose for debris collection. The present invention adds to such a vehicle the availability of a portable wand, normally stored on the vehicle, but removable by the operator when dismounted to collect debris away from the vehicle. The invention is more particularly concerned with such a wand assembly which includes a flexible hose, for example 16' in length, which is collapsible within the wand for storage. Thus, the wand assembly, which includes a tubular wand and the flexible collapsible hose, is stored on the vehicle when not in use, in a minimum amount of space, but may be removed from the vehicle and stretched a substantial distance for use by the operator in collecting debris.

SUMMARY OF THE INVENTION

The present invention relates to trash collection vehicles of the type using a boom supported hose and more specifically to such a vehicle which in addition includes a portable wand, mounted on the vehicle, but removable by the operator for collection of debris away from the vehicle.

A primary purpose of the invention is a wand assembly as described in which the flexible hose connecting the wand assembly to the vehicle is essentially stored within the wand when not in use.

Another purpose of the invention is a debris collection vehicle as described in which the wand assembly support includes a valve for controlling the application of vacuum to the wand assembly.

Another purpose of the invention is a vacuum operated debris collection wand assembly in which the flexible hose permitting movement of the wand for debris collection collapses into the wand for storage.

Other purposes will appear in the ensuing specification, drawings and claims.

BRIEF DESCRIPTION OF THE DRAWINGS

The invention is illustrated diagrammatically in the attached side view of a debris collection vehicle of the type disclosed herein.

DESCRIPTION OF THE PREFERRED EMBODIMENT

The debris collection vehicle of the present invention includes a body 10 mounted on rear wheels 12 and front wheels 14. The body may support a driver's seat 16 and there will be the typical controls for the driver to use in operating the vehicle. These may include foot pedals 18 and 20 and a steering wheel 22, as well as other conventional devices found on vehicles of this type. The vehicle includes both a pickup hose with supporting control elements and what is described as a pickup head. In addition, the vehicle mounts a pickup wand which the operator may use when dismounted to pick up debris located away from the vehicle. The hose is indicated at 24 and the pickup head is indicated at 26. The hose is supported by a counterbalance system indicated generally at 28 and, as shown in the drawing, provides the vacuum to the pickup head 26 by being mounted thereon to a stub tube 30. The opposite end of hose 24 is connected to a cover 32 within which is housed a vacuum fan which will supply vacuum to both the hose 24 and thus to the pickup head 26, as well as to the pickup wand to be described.

The hose 24 is connected to the cover 32 by a coupling 34 and is supported by the counterbalance system 28 which includes a generally vertical rod 36. The hose is manipulated by a telescopic control 38 which has its upper end pivotally connected to the counterbalance system 28 and its lower end pivotally connected to a yoke 40. The yoke 40 is pivotally connected to the nozzle end of hose 24, with the hose being manipulated by the operator, while seated on the vehicle, by means of a handle 42. Details of the boom, handle and pickup head and the use thereof are described in more detail in copending applications filed on even date herewith.

There is a debris canister indicated at 44 which may be tilted from the closed position shown in the drawing to the open broken line position indicated at 46. When the canister is so tilted, the cover 32 must first be opened to permit the canister to move to the position where the debris may be removed from the canister.

In addition to the hose, which is manipulated by the operator from the driver's seat 16, and the pickup head, which also may be utilized by the driver to collect debris while seated on the vehicle, there is a wand assembly indicated generally at 48, which the operator may use when dismounted from the vehicle to collect debris located in areas which may not be accessible by the hose. The wand assembly 48 includes a tubular, slightly curved wand 50 having a handle 52. A wand support 54 is mounted on the vehicle and includes a shutoff valve 56 adjacent its upper end. The shutoff valve may be controlled by the operator to direct vacuum from the vacuum fan within cover 32 to the wand when it is desired for operator use. Preferably, the valve 56 will be a slide valve which opens and closes access to the wand support 54 and the hose, to be described, which is located within it. There is a flexible hose 58 which forms a vacuum connection between cover 32 and the upper end of support 54, just above the location of slide valve 56.

The wand 50, as shown in the drawing figure, contains a flexible, collapsible hose 60. The hose will be attached to the wand adjacent its nozzle 61. The drawing shows the stored or captured position of the hose within the wand 50 and within the tubular portion 62 of support 54. When so stored, the wand 50 will be partially inserted within the tubular portion 62, as shown by the broken lines 64. The hose 60, as indicated, is flexible and is collapsible. When stretched to its full extent by the operator's removal of the wand from the vehicle, the hose may permit the operator to collect debris a distance as much as 16' from the vehicle. When stored, the hose is collapsed by pushing the wand 50 into the open end of the tubular portion 62 of support 54. The hose will collapse, as shown in the drawing, so that a portion of it is stored within the tubular portion 62 of the support 54, with the major portion of the collapsible hose being stored within the wand 50. The end of the hose 60 positioned within the tubular portion 62 may be attached to the outlet end of the valve 56.

When the operator desires to use the wand 50 for debris pickup, the nozzle end of the hose 24 will be placed upon the ground so that little or no air will be drawn in through the nozzle. Thus, the vacuum from the vacuum fan within cover 32 will be applied to the hose connection 58. The operator then dismounts and opens valve 56 so that the vacuum is applied to the hose 60. The operator then removes the wand 50 from the wand support 54 and stretches the collapsible hose 60 to whatever length is desired in order to collect debris where it is located. After the operator has used the wand in this manner, the wand may be replaced on the vehicle by collapsing the hose so that it is again captured within the tubular portion 62 of the support 54 and the tubular wand itself.

The vehicle thus provides three different forms of debris collection. The large diameter hose 24 may be used independently by the operator as the vehicle is driven to collect debris. The operator may place the hose 24 on top of the pickup head 26, as shown in the drawing, so that the hose 24 provides the vacuum for the pickup head which can then collect debris as the operator moves the vehicle. The third alternative is for the operator to ground the nozzle end of the hose 24, open valve 56, and then use the wand away from the vehicle for debris pickup.

Whereas the preferred form of the invention has been shown and described herein, it should be realized that there may be many modifications, substitutions and alterations thereto.

The embodiments of the invention in which an exclusive property or privilege is claimed are defined as follows:

1. A vacuum trash collection vehicle including a debris collection means on the vehicle, a source of vacuum associated with said debris collection means, a hose connected at one end to the debris collection means and having the source of vacuum applied thereto, said hose being open at its other end to form a collection nozzle, a boom on said vehicle for supporting said hose during use as a debris collection device, driver accessible control means for moving said hose and nozzle, a debris collection wand assembly mounted on said vehicle and including a flexible collapsible hose connected at one end to the debris collection means and having the source of vacuum applied thereto, valve means controlling the application of vacuum to said collapsible hose, a tubular portable wand mounted on the vehicle and removable therefrom for debris collection, said collapsible hose extending into said tubular wand for connection thereto, said collapsible hose collapsing into said tubular wand for storage on the vehicle when not in use for debris collection.

2. The vacuum trash collection vehicle of claim 1 wherein said vehicle includes a support for said wand assembly, said wand having an end thereof insertable into said support for wand storage, said collapsible hose being captured within said wand and wand support when said wand is stored on said wand support.

3. The vacuum trash collection vehicle of claim 2 wherein said valve means is located at said wand support.

4. The vacuum trash collection vehicle of claim 2 including a further flexible hose connected between said debris collection means and said wand support.

5. The vacuum trash collection vehicle of claim 1 wherein said wand includes a handle for operator use in manipulating the wand for debris collection.

6. The vacuum trash collection vehicle of claim 1 including a pickup head mounted on said vehicle and having an inlet connection for said boom mounted hose whereby said pickup head may be used for debris collection and said boom mounted hose provides the source of vacuum thereto.

7. A vacuum collection vehicle including a debris collection means on the vehicle, a source of vacuum associated with said debris collection means, a debris collection device connected at one end to the debris collection means and having the source of vacuum applied thereto, driver accessible means for controlling said debris collection device, a debris collection wand assembly mounted on said vehicle and including a flexible collapsible hose connected at one end to the debris collection means and having the source of vacuum applied thereto, valve means controlling the application of vacuum to said collapsible hose, a tubular portable wand mounted on the vehicle and removable therefrom for debris collection, said collapsible hose extending into said tubular wand for connection thereto, said collapsible hose collapsing into said tubular wand for storage on the vehicle when not in use for debris collection.

8. The vacuum collection vehicle of claim 7 including a wand support mounted on said vehicle and having an open end, said wand being insertable into said wand support open end for storage, said collapsible tube being captured within said wand support and tubular wand when said wand is inserted into said wand support.

* * * * *